US005866273A

United States Patent [19]

Wiggins et al.

[11] Patent Number: 5,866,273

[45] Date of Patent: Feb. 2, 1999

[54] CORROSION RESISTANT RAM POWDER

[75] Inventors: Edwin W. Wiggins, South Chesterfield, Mo.; David N. Drennan, Granite City, Ill.

[73] Assignee: The Boeing Company, St. Louis, Mo.

[21] Appl. No.: 496,322

[22] Filed: Mar. 20, 1990

[51] Int. Cl.[6] ..... H01Q 17/00

[52] U.S. Cl. ..... 428/611; 428/641; 428/404; 342/1

[58] Field of Search ..... 428/611, 641, 428/404; 342/1

[56] References Cited

U.S. PATENT DOCUMENTS 3,938,152 2/1976 Grimes et al. ..... 342/1

FOREIGN PATENT DOCUMENTS 61-163123 7/1986 Japan ..... 428/404

OTHER PUBLICATIONS

British Intelligence Objectives Sub–Committee, "Ferromagnetic Materials for Radar Absorption," declassified Apr. 1960.

*Primary Examiner*—R. Dean

*Assistant Examiner*—George Wyszomierski

*Attorney, Agent, or Firm*—George W. Finch

[57] ABSTRACT

An iron-silicon compound powder whose predominant phases are $Fe_5Si_3$, $Fe_2Si$ and $Fe_3Si$, which is useful as a radar absorbing material (RAM) in corrosive and oxidizing atmospheres and when used with corrosive or oxidizing binders is formed by a diffusion process. The powder is made in a process that includes blending magnetic materials such as carbonyl iron, iron cobalt, and/or nickel and very pure silicon powders with an activator, such as a halide salt, and then heating the mixture between 1350° F. and 1600° F. in an inert atmosphere. The result is then ground until it passes through a 200 mesh screen. The powder so formed usually is then heated in air. This forms a thin protective shell about each particle of the powder after which the powder can be combined with a suitable binder to form a RAM coating capable of operating at high temperatures which is relatively unaffected by corrosive atmospheres.

5 Claims, 2 Drawing Sheets

CORROSION RESISTANT RAM POWDER

BACKGROUND OF THE INVENTION

Iron in various forms has been used in radar absorbing material (RAM) applications because it is effective and can be obtained at relatively low cost. Unfortunately, in normal ambient environments iron rusts and looses the magnetic properties that make it effective as a radar absorber. Protective binders have been used to prevent rust, but most are not effective in salt spray environments or those environments that include temperature extremes and abrasive dust, water or ice. Therefore iron silicide alloys, FeSi and $FeSi_2$ in powdered forms, have been produced and used as RAM because a protective silicon dioxide coating can be grown on each particle of the powder by merely heating the compound powder in air. These iron silicide powders have had great success in high temperature applications, but unfortunately their radar absorbing performance per weight and amount of iron is substantially less than those of carbonyl iron powders. Therefore there has been a need to provide a corrosion resistant, preferably iron containing material that has radar absorbing performance approaching that of carbonyl iron powders without resort to expensive ferrous aluminides.

SUMMARY OF THE INVENTION

The present invention is a silicon protected silicide magnetic powder useful as a filler in attenuating coatings and structures that reduce electromagnetic signature and the process for making the same. Usually the magnetic material is carbonyl iron, but cobalt and nickel magnetic alloys also can be used. When carbonyl iron is the primary ingredient, the preferable silicide compounds are $Fe_5Si_3$ and $Fe_2Si$ since they have better signature reduction performance in powdered form than FeSi and $FeSi_2$. The preferred size is below 200 mesh so that the powder will remain suspended in a binder a sufficient time to provide a useful pot life even when low viscosity binders are used to form RAM coatings. $Co_5Si_3$, $Co_2Si$, $Co_3Si$, $Ni_5Si_3$, $Ni_2Si$, and $Ni_3Si$ are formed when cobalt or nickel is present. Cobalt and nickel can be present in the carbonyl structure. They are desirable in very high temperature applications because they raise the Curie point temperature, but are disadvantageous because they reduce the effectiveness of the powder in absorbing electromagnetic radiation. Also, nickel processing can produce toxic products.

The powder of the present invention is prepared by mixing carbonyl iron or iron alloy powder and silicon powder in a weight ratio of between 76% to 83% iron to silicon. It is important that the silicon be of high purity since contaminants in quantities as low as 0.01% can greatly reduce the temperature of the Curie point of the resultant product or cause a double Curie point. Since the desired magnetic properties are reduced or eliminated at the Curie point, a Curie point at a high temperature is especially desirable when the powder is to be used to absorb electromagnetic energy at elevated temperatures. Elevation of the Curie point is not as important when the material is used at lower temperatures.

A 0.1% to 1.5% by weight, halide salt is included in the unreacted blend of magnetic material and silicon as an activator, the lower percentage being preferable. NaF is preferred, but other salts such as $NH_4Cl$, KF, and LiF can be used. When $NH_4Cl$ is used, it must be used in a closed system because $NH_4Cl$ sublimes at low temperatures. The mixture is then heated between 1350° F. and 1600° F. in an inert atmosphere. An inert nitrogen atmosphere is preferred because nitrogen is reasonably available and is economical, but if the reaction is to take place at above 1400° F., argon is preferred to avoid the formation of nitrides. When the activator is NaF, it reacts with the silicon to form a volatile intermediate compound, silicon tetrafluoride ($SiF_4$). The $SiF_4$ gas diffuses the silicon through the surface of the iron powder into the substrate where the silicon combines with the unreacted iron, releasing the fluorine. The fluorine recombines with the sodium to form NaF and thereby continue the process. If the starting mixture is close to 76% iron, then the predominant compound produced is $Fe_5Si_3$, although it may be the mixture $(Fe_2Si)_2$ FeSi. If the starting mixture is close to 80% iron, then the predominant compound formed is $Fe_2Si$.

The sintered material created by the silicon diffusion process is then crushed and screened to the desired particle size, and heated in air to remove unreacted catalyst materials. The required temperature appears to be about 1200° F. but may be as high as 1400° F. A thin silicate protective shell about each powder particle that is usually iron silicate or silicon dioxide or a combination of both also is formed. After the shell has formed, the powder can be heated above 1200° F. without chemical degradation. The powder, from then on can be mixed in corrosive, oxidizing or benign binders to form RAM coatings that can be subjected to adverse environments and temperatures above 500° C. without degradation of electromagnetic performance.

It therefore is an object of the present invention to provide an economical, high performance RAM powder that is stable in corrosive or oxidizing atmospheres.

Another object is to provide a scaleable process with which it is possible to produce environmentally stable RAM powder in large quantities.

Another object is to produce ferromagnetic powder that has a single, relatively high temperature Curie point.

Another object is to provide an economical process capable of producing large quantities of RAM powder whose electromagnetic absorptive performance approaches that of carbonyl iron powders of the same particle size.

Another object is to produce an environmentally stable RAM powder which is effective in a desired frequency range.

These and other objects and advantages of the present invention will become apparent to those skilled in the art after considering the following detailed specification including the the accompanying drawings wherein:

DETAILED DESCRIPTION OF THE INVENTION

Figure 1:
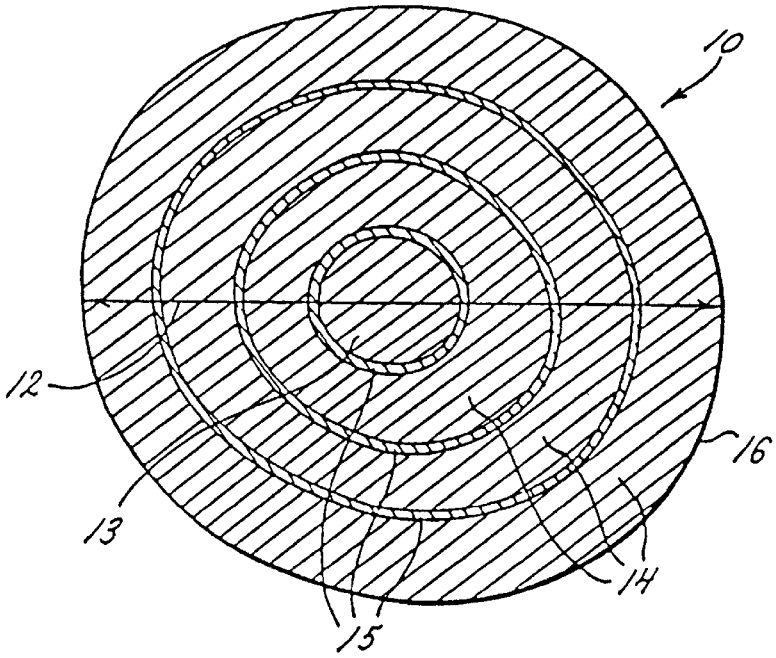
FIG. 1 is a greatly enlarged cross-section of a carbonyl iron particle as are used in the present process.

Referring to the drawings more particularly by reference numbers, number 10 in FIG. 1 refers to a magnetic carbonyl particle having an outer diameter 12 not larger than 10 micrometers (<200 mesh) and a typical size of 5 micrometers. Such particles 10 are commercially available. They are made in a process which results in a core 13 with concentric spheres 14 of magnetic material, usually containing iron. The concentric spheres 14 appear in photomicrographs, to be separated by very thin shells 15 of carbon compounds and other impurities. Relatively economic powder with this composition can be obtained with <1% carbon, <0.5% oxygen, and <0.1% nitrogen as impurities. The shells 15 seem to separate magnetic domains within the particle 10 and produce desired radar absorbing performance.

The present invention is a silicate protected silicide magnetic powder useful as a filler which can be highly loaded into attenuating coatings and structures to reduce electromagnetic signature, and processes for making the same.

Usually the starting magnetic material is carbonyl iron powder made up of the particles 10 but cobalt and nickel magnetic alloy powders also can be used. When carbonyl iron powder is the primary starting ingredient, the preferable silicide alloys are $Fe_3Si$, $Fe_2Si$ and $Fe_5Si_3$ since they seem to have better signature reduction performance in powdered form than FeSi and $FeSi_2$. The preferred powder size is between 200 mesh and 500 mesh (below 10 microns with an average size of 5 microns). When so sized the finished powder will remain suspended in a binder a sufficient time to provide a useful pot life even when low viscosity binders are used to form RAM coatings usually applied with spray techniques. When three dimensional parts are to be cast from a polymer loaded with this powder, a larger particle size, between 100 and 325 mesh, is preferred to obtain the desired loading. A gradation in size seems to improve electromagnetic energy absorption characteristics in both applications.

Figure 2:
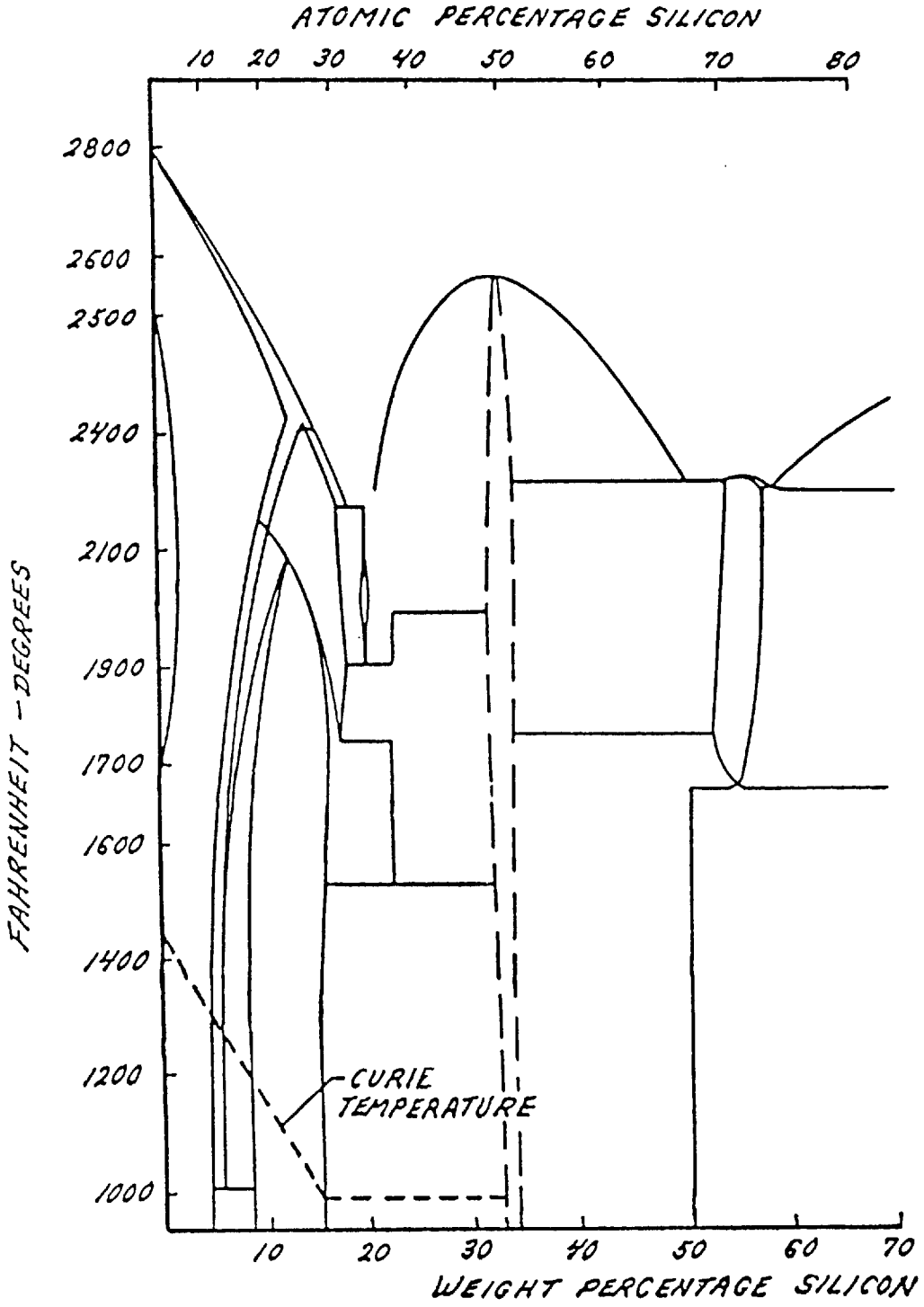
FIG. 2 is a phase diagram for iron silicon compounds.

The powder of the present invention is prepared by mixing the carbonyl iron particles 10 and like sized silicon particles in a weight ratio of between 76% to 83% iron to silicon. If the starting mixture is close to 76% iron, the ideal resultant being 76.8%, then the predominant compound produced is $Fe_5Si_3$. If the starting mixture is close to 80% iron, the ideal resultant being 79.9%, then the predominant compound is $Fe_2Si$. $Fe_3Si$ is desirable because of its high iron to silicon content, but as shown on the phase diagram of FIG. 2, is unlikely to occur in more than equal quantities to $Fe_2Si$ in a slow cooling process. At least 16% silicon is required to provide the desired environmental protection as is shown in Table 1.

TABLE 1

Iron Concentration Characterization

| Iron | TGA performance | Salt Spray |
|---|---|---|
| 76.8% | No Ox thru 1200° C. | 2500+ hours |
| 79.9% | No Ox thru 1200° C. | 2500+ hours |
| 81.5% | No Ox thru 1200° C. | 2500+ hours |
| 83.0% | No Ox thru 1200° C. | 2500+ hours |
| 85.0% | Ox. begins 1150° C. | 700 hours |
| 86.0% | Ox begins 1000° C. | 350 hours |
| 88.0% | Ox. begins 1000° C. | 40 hours |
| 90.0% | Ox. begins 1000° C. | 40 hours |
| 100% | Ox. begins 300° C. | 24 hours |

It is important that the silicon powder be of high purity (>99.99%). Contaminants such as copper and aluminum in quantities as low as 0.01% can cause a curious double Curie point where half the magnetic properties are lost at temperatures as low as 85° C. and the remaining magnetic properties are lost at 450° C. Since the desired magnetic properties are reduced or eliminated at the Curie point, a high temperature Curie point is especially desirable when the resulting iron silicon compound powder is to be used at elevated temperatures.

A 0.1% to 1.5% by weight, halide salt is included in the mixture as an activator. The lower percentages are preferred because the salt can act as an impurity in the product. NaF is preferred because of its reactive efficiency, but other salts such as $NH_4Cl$, LiF and KF can be used. The mixture is then heated between 1350° F. and 1600° F. in an inert atmosphere. Tests have shown that the desired diffusion does not proceed at temperatures below 1300° F. Temperatures higher than 1350° F. cause the process to proceed faster, but more energy is required for the heat up cycle, more expensive equipment is required, and more sintering takes place. Different percentages of the phases may occur at higher processing temperatures. Sintering is undesirable because the product then requires more grinding and grinding is difficult because the sintered product is very abrasive. Also, above 2200° F., undesirable iron silicon materials form. Nitrogen is preferred for the inert atmosphere because it is readably available, is economical, and if a slight amount of nitrogen compounds forms in the process, they do not seem to affect the result adversely. Other inert gases, such as argon, have been used, but their additional expense does not appear to be justified by improvements in the final product.

Figure 3:
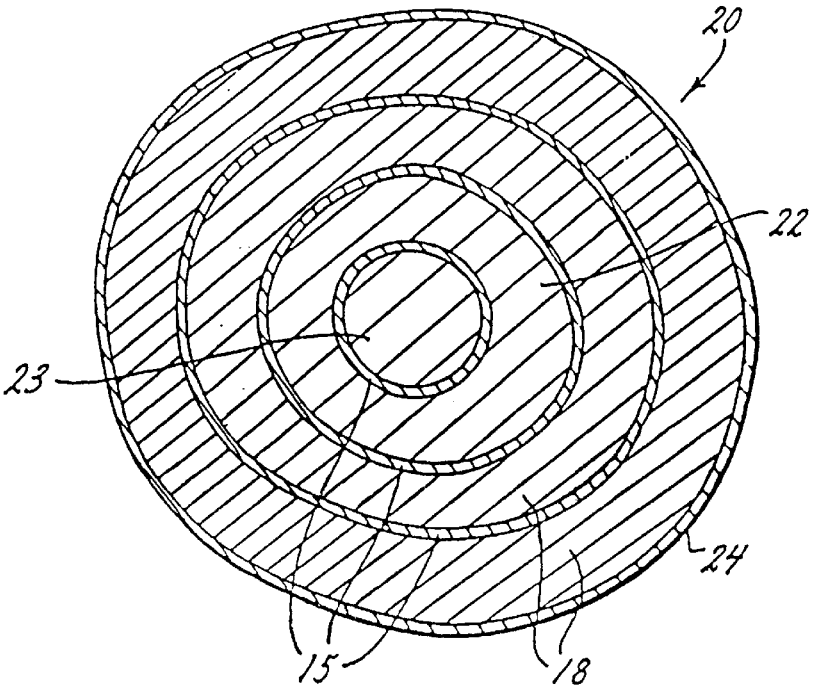
FIG. 3 is what is believed to be the cross-section of the particle of FIG. 1 after it has been though the present process.

When the activator is NaF, it reacts with the silicon powder to form an intermediate compound, silicon tetrafluoride ($SiF_4$) which is a gas. The $SiF_4$ gas transports the silicon through the surface 16 of the carbonyl particles 10 to diffuse into the substrate where the silicon alloys with the unreacted iron releasing the fluorine. The fluorine recombines with the sodium to form NaF that reacts with the remaining silicon and continues the process until all of the silicon is diffused into and alloyed with the iron or until the temperature is reduced well below 1300° F. There appears to be a gradient of silicon concentration across the particle 20 (FIG. 3) toward the core 13 when the process is not allowed to go to steady state, which results in a higher concentration in the outer layers 18. Since the diffusion process works from the outer surface 16 inward, it is believed that the outer layers 18 of the resultant iron-silicon particle 20 are more likely to be $Fe_5Si_3$ while $Fe_2Si$, and $Fe_3Si$ are more likely to be in the inner layer 22 and the core 23. The best electromagnetic performance observed is produced when the starting iron weight percentage is 79.87%, so that the resultant iron weight percent is 79.9%.

A sintered billet, created by the silicon diffusion process, is then crushed and screened through a 200 mesh to the desired particle size, and heated in air at about 1200° F. to remove unreacted catalyst materials. A thin protective shell 24 about each powder particle 20, which is believed to be $SiO_2$, also is formed. Lower temperatures can be used and the formation of the shell 24 has been observed at room temperatures but at a very slow rate. After the shell 24 has formed, the particle 20 can be heated above 1200° F. without chemical degradation.

The $SiO_2$ protective shell can be formed before the billet is cooled down and crushed by introducing oxygen into the process during the cool down cycle at 1200° F. and holding the temperature at 1200° F. until a suitably thick $SiO_2$ protective shell has been formed. Usually this takes about 2 hours. This single cool down modification to the process is most effective if a minimum temperature is used during the diffusion process since a complete shell 24 is more likely to form if the particles 20 are subjected to less sintering. The particles 20, thereafter can be mixed in corrosive, oxidizing or benign binders to form RAM coatings that can be subjected to adverse environments and temperatures above 500° C. without degradation of electromagnetic performance.

The following are examples of the process of the present invention being operated at different parameters:

Mix 79.87 weight percent carbonyl iron particles capable of passing a 200 mesh screen, 20.03 weight percent 99.99%+ pure silicon powder and 0.1 weight percent sodium fluoride powder in a twin shell V-blender. Pour a quantity of the mixed powder into a porcelain crucible and cover. Heat the crucible to 1600° F. for 2 hours in an argon atmosphere. The following reactions take place.

$$4NaF+Si>SiF_4+4Na$$

$$SiF_4+2Fe>Fe_2Si+F_2$$

$$4Na+2F_2>4NaF$$

Remove the sintered mass of material from the crucible. Crush and grind the material and screen through a 200 mesh sieve. Retain the −200 mesh material and recycle the +200 mesh material through the grinding. Use only material that is ground to pass through 200 mesh. If there is any residual fluoride catalyst such as when more than 0.1 weight percent of NaF is used, wash it from the powder with deionized water. Then filter the powder out of the water and dry. Heat the powder in an atmosphere containing oxygen at less than 1300° F. Upon cooling, the powder is ready for immediate use as a RAM filler.

Perform the same process as above, but instead heat the powder in an atmosphere containing oxygen at 1400° F.

Perform the same process as above but instead of heating the powder in an atmosphere containing oxygen at less than 1300° F., expose the powder to an atmosphere containing oxygen for a substantial time before use as a filler.

Perform the same processes as above but, use nitrogen instead of argon.

Perform the same processes as above, but use an iron alloy containing cobalt or nickel or both to raise the Curie point temperature. When a 20% cobalt substitution for iron and a 20.1% silicon was used, a Curie temperature of 650° C. was achieved Perform the above processes, but start with a mixture that is 76.8 weight percent carbonyl iron particles capable of passing a 200 mesh screen, 21.7 weight percent 99.99% pure silicon powder and 0.1 weight percent sodium fluoride powder so that the predominant silicide produced is $Fe_5Si_3$ rather than $Fe_2Si$ or $Fe_3Si$.

Perform the above processes, but heat the mixture at 1350° F. instead of 1600° F. to reduce the amount of sintering and therefore reduce the amount of crushing and grinding required.

Perform the above process, but allow air in contact with the reacted mixture while it is cooling down below 1300° F. before to crushing to eliminate the separate air heating step.

As a production process mix 79.8 weight percent 1–10 $\mu$m carbonyl iron particles, 20.1 weight percent 99.99% pure, −325 mesh silicon metal powder and 0.1 weight percent sodium fluoride powder in a blender. Pour the mixed powder into crucibles and cover. Heat the crucible to 1600° F. for 2 hours in a nitrogen atmosphere. Remove the sintered material from the crucibles. Crush the sintered material in a jaw crusher to <¼". Grind the material in a shatter box and screen through a 200 mesh sieve. Retain the −200 mesh material and recycle the +200 mesh material through the grinding. Use only material that is ground to pass through 200 mesh. Heat the powder in an atmosphere containing oxygen at less than 1300° F. to put a silicate coating on the particles and to drive off any remaining fluorine or sodium. The powder is ready for immediate use as a RAM filler once it has cooled.

Perform the above production process, but heat the mixture to 1350° F. to eliminate rigorous crushing.

Perform the above process production but allow the powder to be exposed to an atmosphere containing oxygen at less than 1300° F. during cool down from the diffusion reaction.

Perform the above production process but heat the mixture for less than 2 hours with agitation so that the inner shells of the carbonyl iron particles remain silicon poor.

Perform the same processes as above but use an iron alloy containing cobalt or nickel or both to raise the Curie point temperature.

Thus, there has been shown and described novel powders and processes of making the powders useful as RAM, which fulfill all the objects and advantages sought therefor. Many changes, modifications, variations, alterations and other uses and applications of the subject invention will become apparent to those skilled in the art after considering this specification and drawing. All such changes, modifications, variations, and other uses and applications that do not depart from the spirit and scope of the invention are deemed to be covered by the invention that is limited only by the claims which follow.

What is claimed is:

1. A particle useful as a radar absorbing material that can withstand extreme temperatures and hostile environments having:

a generally spherical shape;

a core including magnetic material;

at least one magnetic shell including silicon and an element that has magnetic forms positioned about said core;

a layer containing carbon between said core and said at least one shell and between any two of said shells; and an outer protective layer on the particle that includes an oxide of silicon.

2. The particle as defined in claim 1 wherein said at least one shell includes at least one silicide which is magnetic.

3. The particle as defined in claim 2 wherein said at least one silicide is chosen from the group consisting of:

$Fe_5Si_3$; $Fe_2Si$; $Fe_3Si$; $Co_5Si_3$; $Co_2Si$; $Co_3Si$; $Ni_5Si_3$; $Ni_2Si$; and $Ni_3Si$.

4. The particle as defined in claim 1 further including:

a plurality of silicide shells between said outer protective layer and said at least one shell, said silicide shells, which are closer to said outer protective layer, having a higher percentage of said silicon to said element than those silicide shells closer to said core.

5. The particle as defined in claim 1 wherein said outer protective layer includes at least one silicon containing compound chosen from the group consisting of:

iron silicate; and silicon dioxide.

* * * * *